United States Patent [19]

Kocon et al.

[11] Patent Number: 4,631,778

[45] Date of Patent: Dec. 30, 1986

[54] SELF LOCKING DOOR RETARDER AND HINGE

[75] Inventors: Florian T. Kocon, Allentown; Kurt A. Geiger, Danielsville, both of Pa.

[73] Assignee: Fuller Company, Bethlehem, Pa.

[21] Appl. No.: 758,896

[22] Filed: Jul. 25, 1985

[51] Int. Cl.[4] ..... E05D 7/00

[52] U.S. Cl. ..... 16/337; 16/341

[58] Field of Search ..... 16/337–342, 16/277, 292, 297

[56] References Cited

U.S. PATENT DOCUMENTS 2,682,077 6/1954 Vikre ..... 16/337

2,872,697 2/1959 Hizsa, Jr. ..... 16/342

*Primary Examiner*—James M. Meister

*Attorney, Agent, or Firm*—Frank H. Thomson

[57] ABSTRACT

A door and hinge mechanism particularly adapted for use in a conical hopper where the door may be on the down side of the hopper. The hinge pin connecting the fixed hinge element with the movable hinge element is placed under tension by springs such as Belville washers so that the hinge pin is not freely rotatably in the fixed hinged element. The movable hinge element includes a cam member which rotates about an off-set axis until the cam surface engages the hinge pin to prohibit further free rotation of the movable hinge. A force must then be applied to the door supplementing gravity to rotate the movable hinge element and hinge pin relative to the fixed hinge element to thereby open the door.

10 Claims, 9 Drawing Figures

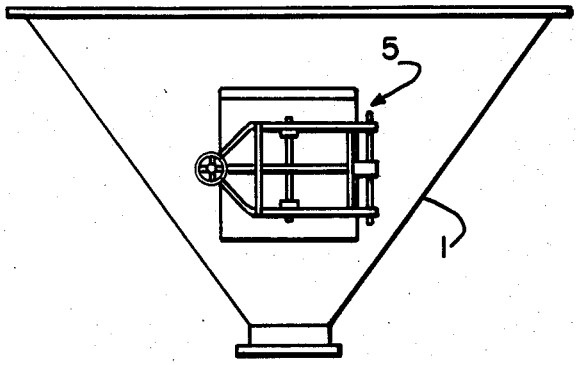
FIG. 1
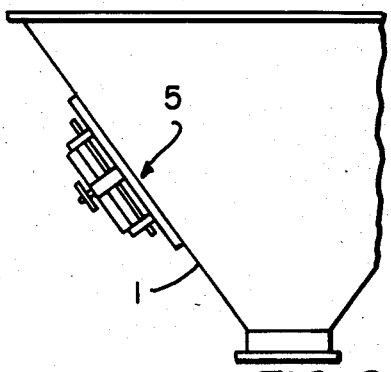
FIG. 2
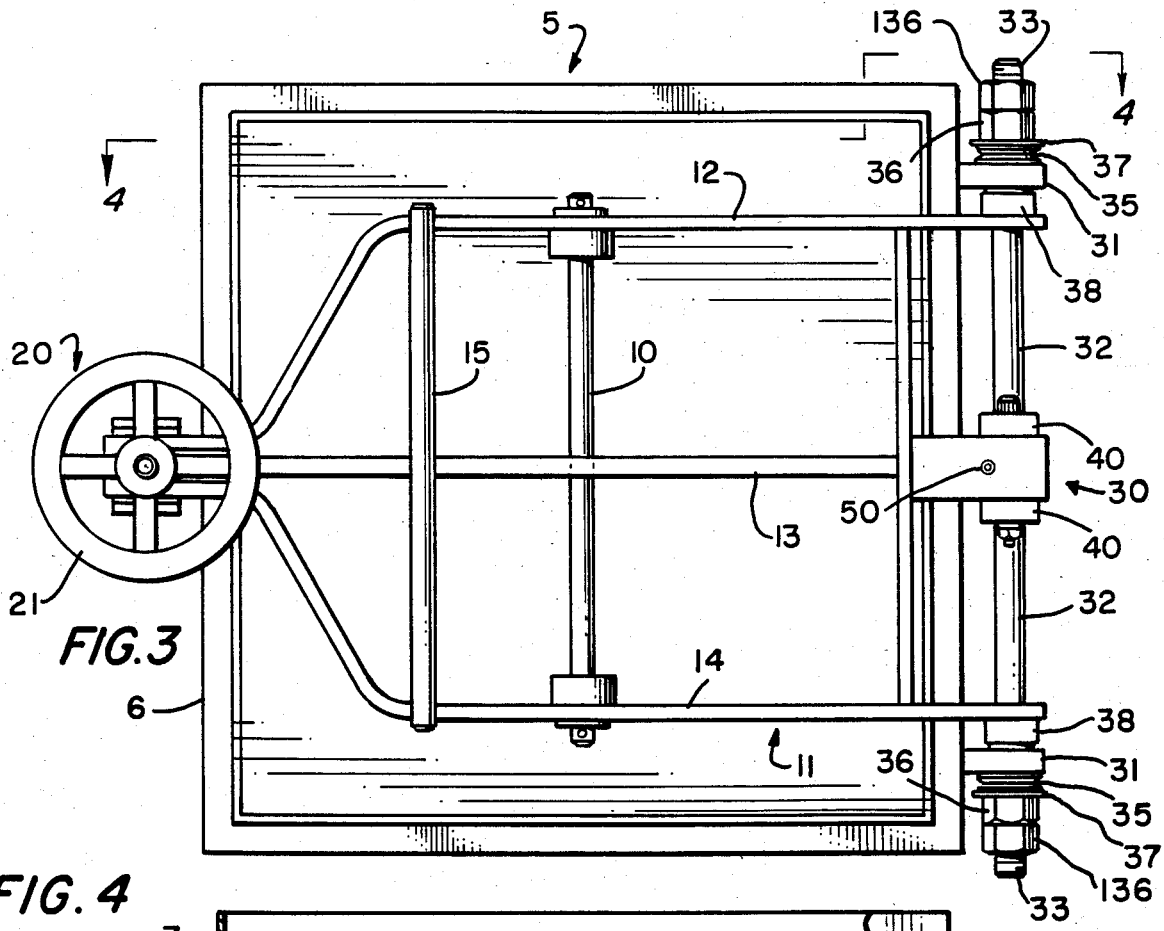
FIG. 3
FIG. 4
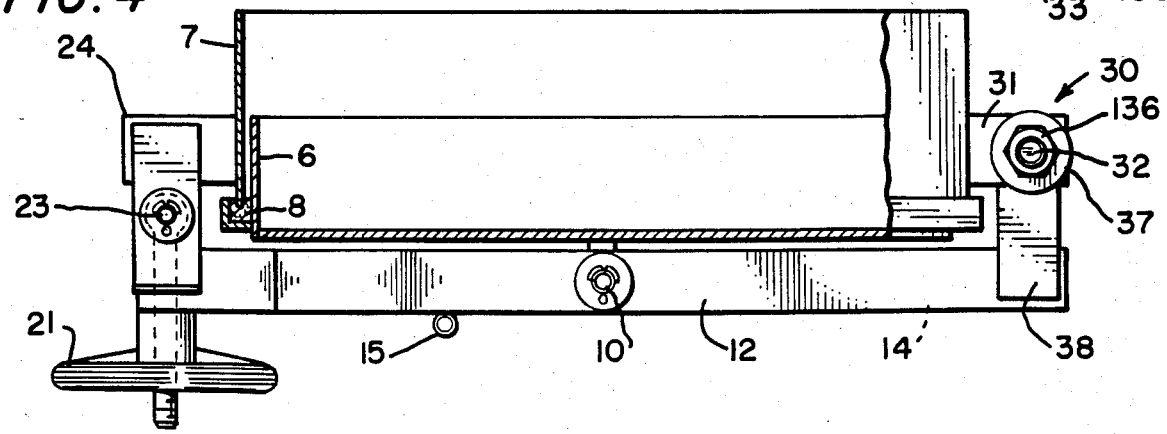

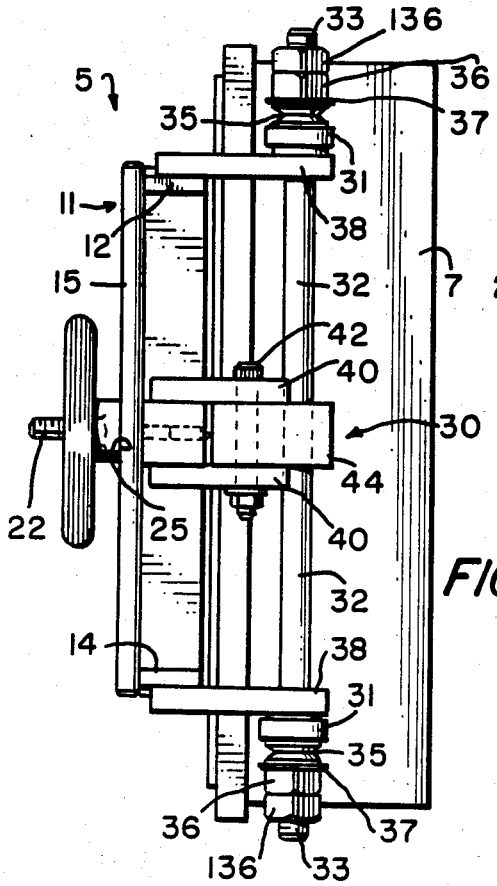
FIG. 5
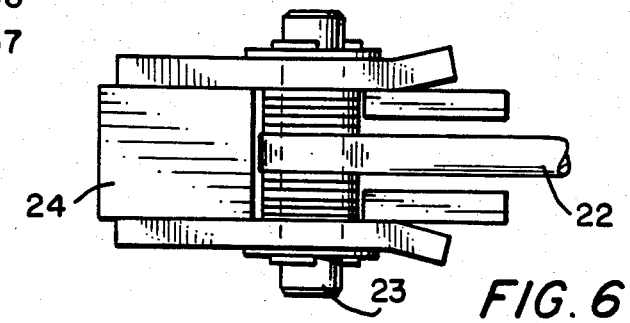
FIG. 6
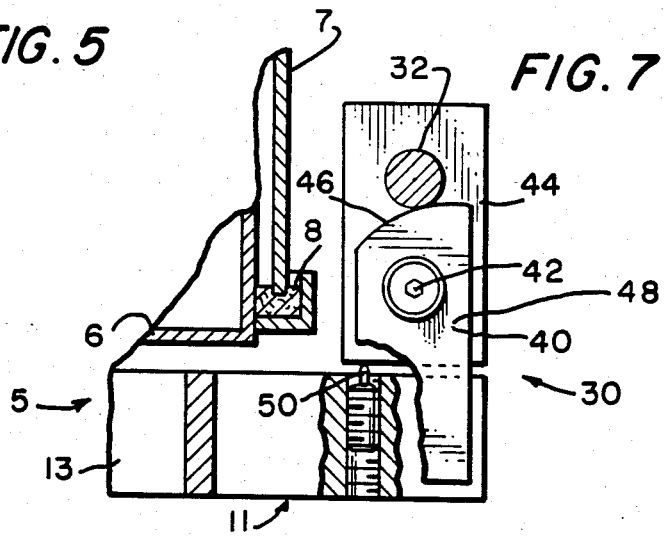
FIG. 7
FIG. 8
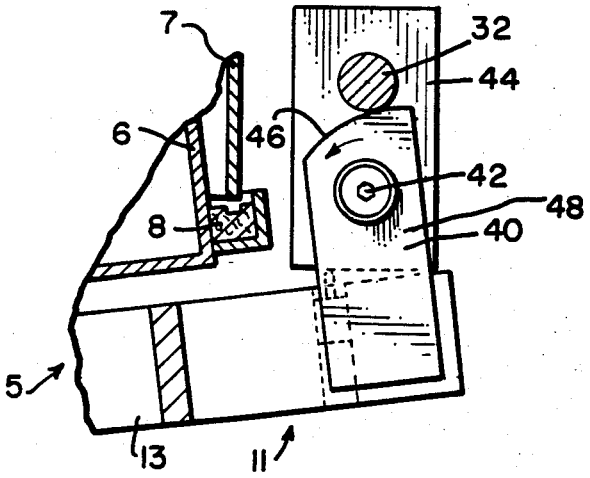
FIG. 9
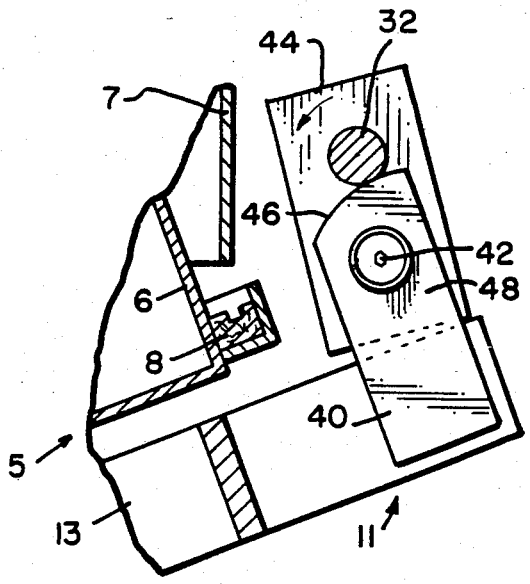

SELF LOCKING DOOR RETARDER AND HINGE

BACKGROUND OF THE INVENTION

This invention relates to door mechanisms particularly designed for use on conical hoppers or other locations where the door will open in a downward direction.

Manholes or clean out ports are common in various vessels. If such a clean out port or manhole is placed on the down side of a conical hopper, once the latch mechanism holding the door locked in place is removed, gravity will cause the door to swing freely down. If a maintenance person is in the area, this swinging door may cause physical harm to that maintenance person by swinging open more rapidly than anticipated and because of its weight may cause severe personal injury.

While a door can be made out of light weight material, in many applications it is not practical to use a light weight material and even if it is practical, the door will still swing open on its own.

It would be desirable to provide a simple mechanism for limiting the free movement of the door in a downward direction.

SUMMARY

It is therefore the principal object of the invention to provide a hinge mechanism or self locking door which substantially prevents the door from freely swinging open as by through the force of gravity.

In general, the invention will be carried out by providing a door mechanism comprising a door, a door frame, a fixed hinge element secured to said door frame, a moveable hinge element secured to said door and a hinge pin rotatably mounted in said fixed hinge element; said movable hinge element including a first member fixed to said door and rotatable about an axis and having a first surface for engaging the hinge pin after the first member is rotated, a predetermined amount by initial opening of the door and locking said first member to said hinge pin after said first member rotates said predetermined amount for causing said first member and said hinge pin to rotate together about the axis of the hinge pin on further opening of said door.

The self locking mechanism is carried out by placing the hinge pin under tension by means of springs such as Belville washers. According to the invention, the door will swing open by gravity a slight amount until a cam surface which forms part of the movable hinge element jams against the hinge pin. The hinge pin is under sufficient tension so that the force of gravity alone acting on the door will be inadequate to rotate the hinge pin to allow the door to swing freely open. In order to open the door, it will be necessary to apply additional force to the door to rotate the movable hinge element and hinge pin relative to the fixed hinge element.

BRIEF DESCRIPTION OF THE DRAWINGS

The invention will be described in connection with the annexed drawings wherein:

FIG. 1 is a plan view of a hopper bottom employing a door according to the present invention;

FIG. 2 is a view similar to FIG. 1 showing the hopper rotated 90° with the gas inlets on the hopper removed for clarity;

FIG. 3 is a plan view on an enlarged scale of the door according to the present invention;

FIG. 4 is a sectional view taken on the line 4—4 of FIG. 3 looking in the direction of the arrows;

FIG. 5 is an end view of the door mechanism shown in FIG. 3;

FIG. 6 is a detail of the latch mechanism on an enlarged scale;

FIG. 7 is a fragmentary view of the hinge mechanism with the door shown in a closed position;

FIG. 8 is a view similar to FIG. 7 with the door rotated to an initial open position; and FIG. 9 is a view similar to FIGS. 7 and 8 showing the hinge mechanism with the door in a further open position.

DESCRIPTION OF THE PREFERRED EMBODIMENT

Referring to the drawings, the invention is particularly adapted for use in connection with a door mechanism which forms part of a conical bottom hopper of various apparatus such as a air classifying device. The hopper is generally indicated at 1. As can be seen from FIG. 2, a door mechanism generally indicated at 5 is on the downward slope of the hopper 1. With a convential door and hinge mechanism if the door latch mechanism were opened, gravity would cause the door to freely swing open. With a heavy door a violent action may cause personal injury to a maintenance person opening the door.

The door apparatus 5 may include a door 6 with a door frame 7. In a preferred form, the door 6 is floatingly or pivotally mounted by means of a bar 10 on a support structure 11. The structure 11 includes three spaced apart bars 12, 13, and 14 with bar 10 interconnecting these three bars. A further bar element 15 may be used for structural stability. The purpose of the floating door 6 is to ensure that the door fits within frame 7 without requiring unnecessary machining and close tolerances. A seal element 8 may extend around the periphery of the door 6 to maintain a gas tight seal within the hopper.

A conventional hand wheel type latch generally indicated at 20 may be utilized for locking the door in a closed position. This mechanism includes a hand wheel 21 threadedly connected to a rod 22 which is pivotal about a pin 23. The pin 23 is fixed to the door frame 7 through element 24 as shown in FIG. 6. When the wheel 21 is tightened, the bottom 25 of the wheel serves to secure frame bars 12 and 14 to the door frame 7 through element 24. When the hand wheel 21 is loosened, it may be pivoted around pin 23 to swing out of the way in a conventional manner and permit the door 6 to be opened.

The hinge mechanism itself is generally indicated at 30 and includes a pair of spaced apart fixed hinge elements 31 which are secured as by welding to the door frame 7; see FIGS. 3 and 4. A hinge pin 32 having threaded ends 33 is mounted for rotation about its own longitudinal axis in the fixed hinge elements 31. The hinge pin 32 is placed under tension by means of a series of spring means or Belville washers 35 placed at each end of the hinge pin 32 betwen a nut 36 and washer 37 and the fixed hinge element 31. As the nut is tightened, the hinge pin 32 will be placed under tension so that it is not freely rotatably in the fixed hinge elements 31 but rather must be rotated by applying a torsional force to the hinge pin. Jam nuts 136 may be added to pin 32 to prevent loosening of nuts 36.

The loose or movable hinge element includes a pair of spaced apart bars 38 secured at one end to the bars 12 and 14 which make up the frame 11 of the door 6 with the hinge pin 32 rotatably extending through the other end. The loose half of the hinge also includes a pair of spaced apart cam members or first members 40 which are secured as by welding to the support structure 11 of door 6 and pivotally connected at 42 to an intermediate bar 44. The bar 44 is fixed to the hinge pin 32; see FIGS. 5 and 7 to 9. The cam members or first members 40 are rotatable about their own axis of rotation 43 relative to the fixed hinge element 31 and the hinge pin 32 during initial pivotal movement of the movable hinge element. A spring biased detent 50 ensures that the element 44 is placed under tension as the door is swung open.

The cam or first member 40 includes a curved surface 46 which has its axis of rotation located at a point 48 which is offset from the axis of rotation 42 of the cam member 40.

In operation, when the latch mechanism or hand wheel 20 is pivoted to an open position to permit the door 6 to swing open, gravity will act on the door to permit the door 6 to swing open a predetermined amount which is determined by the members 40 rotating about axis 42 until the surface 46 jams or locks against the hinge pin 32. This initial pivotal movement of the door 6 and movable hinge element is shown by movement from the position shown in FIG. 7 where the door is closed to the position shown in FIG. 8. In position shown in FIG. 8, the door is opened only a slight amount and should not cause any potential personal injury problems to a person opening the door. In addition, the door will only be slightly ajar and dusty material within the hopper will be retained within the hopper.

Because the hinge pin 32 is placed under tension, the hinge pin and the movable hinge element will not be free to rotate any further than the position shown in FIG. 8. The cam surface 46 defines a means for locking the first member 60 and hence the door 6 to the hinge pin 32 after the door 6 and first member 40 move a predetermined amount. In order to open the door, torsional force in addition to gravity will need to be applied to the door. When this additional force is applied, the door will not rotate about the axis 42 because the member 40 is jammed or locked against hinge pin 32. Instead, the force will overcome the spring tension applied to the hinge pin 32 so that further piviotal movement of the door and first member 40 causes the cam member 40, and cam surfaces 46, door 6, and hinge pin 32 to rotate together relative to the fixed hinge 31 and door frame 7 about the longitudinal axis of the hinge pin 32. When closing the door, the cam or first member 40 rotates about the axis 42 until the cam surface 46 disengages from hinge pin 32, then the movable hinge element bars 38 and intermediate bar 44 rotate freely about the axis 42 until the door is shut and latch in place by handwheel 21.

The hinge pin 32, which is under tension does not turn when closing the door.

In closing the door the maintenance person only has to overcome the weight of the door.

Thus, it can be seen that a mechanism has been provided which carries out the object of the invention. The door is self retarding in that it will only open a given amount by the force of gravity alone thereby avoiding the threat of personal injury and that additional force is required to open the door.

It is intended that the foregoing be description of a preferred embodiment and that the invention be limited solely by that which is in the scope of the appended claims.

We claim:

1. A hinge comprising a fixed hinge element, a movable hinge element and a hinge pin pivotally connecting the movable hinge element to the fixed hinge element; said movable hinge element including a first member rotatable about its own axis of rotation relative to the fixed hinge element and the hinge pin during initial pivotal movement of the movable hinge element; said first member including means for locking said first member to said hinge pin after said first member moves a predetermined amount so that further pivotal movement of said first element causes said first member and said hinge pin to rotate together relative to said fixed hinge about the longitudinal axis of the hinge pin.

2. A hinge according to claim 1 further comprising means for constraining the hinge pin to prevent said hinge pin from rotating freely relative to said fixed hinge element.

3. A hinge according to claim 1 another comprising spring means for placing said hinge means in tension to prevent said hinge pin from rotating freely relative to said fixed hinge element.

4. A hinge according to claim 3 wherein said means for locking said first member to said hinge pin is defined by a curved surface on said first member having its center of curvature off set from the axis of rotation of the first member.

5. A hinge according to claim 1 wherein said means for locking said first member to said hinge pin is defined by a curved surface on said first member having its center of curvature off set from the axis of rotation of the first member.

6. A door mechanism comprising a door, a door frame, a fixed hinge element secured to said door frame, a movable hinge element secured to said door, and a hinge pin rotatably mounted in said fixed hinge element; said movable hinge element including a first member fixed to said door and rotatable about an axis and having a first surface for engaging the hinge pin after the first member is rotated a predetermined amount by initial opening of the door and locking said first member to said hinge pin after said first member rotates said predetermined amount and for causing said first member and said hinge pin to rotate together about the axis of the hinge pin on further opening of said door.

7. A door mechanism according to claim 5 wherein said hinge pin is placed in tension by spring means to prevent said hinge pin from being freely rotatable in the fixed hinge element to thereby require the application of additional force to the door to open the door more than said initial opening.

8. A door mechanism according to claim 7 wherein said first surface is rounded and has its center of curvature off set from the axis of rotation of the first member.

9. A door mechanism according to claim 7 wherein said fixed hinge element is defined by at least a pair of spaced apart brackets rotatably supporting said hinge pin, and said first member includes a pair of spaced apart bars, each pivotally connected to an intermediate bar which is fixed to the hinge pin.

10. A door mechanism according to claim 9 further comprising a spring biased detent for maintaining contact between said door and said intermediate bar.

* * * * *